US007874591B2

(12) United States Patent
Korich

(10) Patent No.: US 7,874,591 B2
(45) Date of Patent: Jan. 25, 2011

(54) APPARATUS AND METHOD FOR CANTING A SKIER

(75) Inventor: Chris Korich, Oakland, CA (US)

(73) Assignee: Biostance LLC, Vail, CO (US)

( * ) Notice: Subject to any disclaimer, the term of this patent is extended or adjusted under 35 U.S.C. 154(b) by 1026 days.

(21) Appl. No.: 11/397,228

(22) Filed: Apr. 3, 2006

(65) Prior Publication Data

US 2007/0108734 A1 May 17, 2007

Related U.S. Application Data

(60) Provisional application No. 60/736,470, filed on Nov. 12, 2005.

(51) Int. Cl.
*A63C 11/00* (2006.01)

(52) U.S. Cl. ..... 280/809; 280/11.3

(58) Field of Classification Search ..... 280/11.12, 280/11.14, 11.3, 600, 601, 602, 607, 609, 280/611, 617, 618, 620, 633, 636
See application file for complete search history.

(56) References Cited

U.S. PATENT DOCUMENTS

| | | | | |
|---|---|---|---|---|
| 3,786,580 A | | 1/1974 | Dalebout | |
| 3,828,448 A | | 8/1974 | Leonildo | |
| 3,917,298 A | * | 11/1975 | Haff | 280/607 |
| 3,922,800 A | | 12/1975 | Miller | |
| 3,950,000 A | * | 4/1976 | Sittmann | 280/636 |
| 4,074,446 A | * | 2/1978 | Eisenberg | 36/117.5 |
| 4,078,322 A | * | 3/1978 | Dalebout | 36/117.4 |
| 4,141,570 A | | 2/1979 | Sudmeier | |
| 4,314,411 A | | 2/1982 | Hanson | |
| 4,351,120 A | | 9/1982 | Dalebout | |
| 4,358,904 A | | 11/1982 | Guild | |
| 4,499,674 A | | 2/1985 | Olivieri | |
| 4,500,108 A | * | 2/1985 | Johnson, III | 280/614 |
| 4,523,395 A | | 6/1985 | Borsoi | |
| 4,543,738 A | | 10/1985 | Mower | |
| 4,665,576 A | | 5/1987 | Limbach | |

(Continued)

FOREIGN PATENT DOCUMENTS

DE 33 33 318 A1 3/1985

(Continued)

OTHER PUBLICATIONS

Int'l Org. for Standardization, International Standard, Alpine Skis and Bindings, Ref. No. ISO 8364:1991(E), pp. 1-5, ISO, Case Postale 56, CH-1211 Geneva, Switzerland.

(Continued)

*Primary Examiner*—J. Allen Shriver, II
*Assistant Examiner*—Vaughn T Coolman
(74) *Attorney, Agent, or Firm*—Charles E. Krueger

(57) ABSTRACT

An apparatus and method for canting a skier comprising a cant angle plate that locks on to the heel bearing surface of a ski binding. The cant angle plate has portions of varying thickness for inducing a cant angle when the heel of a boot rests on the cant angle plate locked on to the heel bearing surface of the binding. Thus, the cant angle plate alters the cant angle at which a boot supports a skier's foot and lower leg, relative to the longitudinal running surface or bottom plane of an attached ski.

9 Claims, 9 Drawing Sheets

U.S. PATENT DOCUMENTS

| | | | | | |
|---|---|---|---|---|---|
| 4,694,684 | A | | 9/1987 | Campbell | |
| 4,765,070 | A | | 8/1988 | Chemello | |
| 4,791,736 | A | | 12/1988 | Phillips | |
| 4,945,659 | A | | 8/1990 | De Marchi et al. | |
| 5,005,301 | A | | 4/1991 | Mabboux | |
| 5,090,139 | A | | 2/1992 | Germann | |
| 5,135,250 | A | * | 8/1992 | Abondance et al. | 280/617 |
| 5,188,386 | A | * | 2/1993 | Schweizer | 280/607 |
| 5,293,702 | A | | 3/1994 | Miyoshi | |
| 5,297,812 | A | * | 3/1994 | Dogat et al. | 280/633 |
| 5,344,176 | A | * | 9/1994 | Trimble | 280/602 |
| 5,348,335 | A | | 9/1994 | Dasarmaux | |
| 5,360,229 | A | | 11/1994 | Arduin | |
| 5,413,371 | A | | 5/1995 | Trimble | |
| 5,474,321 | A | | 12/1995 | Pritz | |
| 5,492,356 | A | | 2/1996 | Astier | |
| 5,501,483 | A | | 3/1996 | Stepanek | |
| 5,538,271 | A | | 7/1996 | Abondance | |
| 5,558,356 | A | | 9/1996 | Challande | |
| 5,560,634 | A | | 10/1996 | Challande | |
| 5,566,968 | A | | 10/1996 | Challande | |
| 5,611,559 | A | | 3/1997 | Luitz | |
| 5,615,901 | A | | 4/1997 | Piotrowski | |
| 5,647,605 | A | | 7/1997 | Arduin | |
| 5,671,939 | A | | 9/1997 | Pineau | |
| 5,803,467 | A | | 9/1998 | Piotrowski | |
| 5,884,934 | A | | 3/1999 | DeRocco | |
| 5,915,718 | A | * | 6/1999 | Dodge | 280/607 |
| 5,992,861 | A | | 11/1999 | Piortrowski | |
| 6,290,251 | B1 | * | 9/2001 | Chatillon et al. | 280/636 |
| 6,328,328 | B1 | * | 12/2001 | Finiel | 280/636 |
| 6,371,506 | B1 | * | 4/2002 | DeNicola | 280/607 |
| 6,609,313 | B2 | | 8/2003 | Orso | |
| 6,715,782 | B2 | | 4/2004 | Sosin | |
| 7,097,195 | B2 | * | 8/2006 | Orr et al. | 280/628 |
| 2005/0029757 | A1 | * | 2/2005 | Fiebing | 280/14.24 |

FOREIGN PATENT DOCUMENTS

| | | |
|---|---|---|
| FR | 2086994 | 12/1971 |
| GE | 2953208 | 10/1980 |
| WO | WO 98/18528 A | 5/1998 |

OTHER PUBLICATIONS

Int'l Org. for Standardization, International Standard, Alpine Ski-Boots, Ref. No. ISO 5355: 1997(E), pp. 1-7, 25, ISO, Case Postale 56, CH-1211 Geneva, Switzerland.

Witherell, Warren and Evrard, David, The Athletic Skier, copyright 1993, pp. 19-65, published by The Athletic Skier, Salt Lake City, Utah.

* cited by examiner

APPARATUS AND METHOD FOR CANTING A SKIER

RELATED APPLICATIONS

This application claims priority from a provisional application filed Nov. 12, 2005 entitled SYSTEM AND METHOD FOR CANTING A SKIER, Application No. 60/736,470 which is hereby incorporated by reference for all purposes.

BACKGROUND OF THE INVENTION

To maximize skiing enjoyment, proficiency, and safety, all skiers should have their equipment anatomically adjusted. One of the most critical anatomical adjustments is referred to as "canting".

Canting alters the lateral tilt or "cant angle" at which a boot supports a skier's foot and lower leg, relative to the longitudinal running surface or bottom plane of an attached ski. Optimizing the cant angle improves skeletal alignment and allows the skier to tilt or "edge" the ski with the least amount of muscular effort.

In the 1993 book "The Athletic Skier", authors Warren Witherell and David Evrard wrote that, "Only when properly canted can our bodies and skis work as efficiently as possible. By tilting or canting our boots, we can precisely control the geometry of our legs and establish an ideal position over our skis. Canting is the final step in the alignment process that makes efficient and balanced skiing possible for all skiers."

Recent changes in equipment design have only magnified the importance of optimizing a skier's cant angle. Some of these changes include the lateral stiffening of boot shells, the increased elevation or stand-height of binding systems, and the exaggerated sidecut or shape of modern skis.

Unfortunately most ski shops still do not offer canting services, therefore, only a small percentage of skiers ever have their cant angle tested or altered. There are numerous reasons for this which will become apparent in the review of prior art.

DESCRIPTION OF PRIOR ART

Various prior art exists for altering the cant angle at which a boot supports a skier's foot and lower leg, relative to the longitudinal running surface or bottom plane of an attached ski. All methods to date have been based on a universal belief that canting must include modifications under both the toe and heel support portions of a boot or binding.

The classic method is to mount wedge-shaped shims or "cants" between the top surface of the ski and the under surface of both the toe and heel units of the binding. Some skiers have used strips of tape on both the toe and heel as temporary or test cants, as depicted in "The Athletic Skier", Chapter 34.

Another well-known method for altering the cant angle is to permanently grind or plane the bottom toe and heel sole portions of the boot.

A reversible variation of this technique is to use interchangeable "canted soles" as described in U.S. Pat. Nos. 4,078,322 and 4,945,659.

Another approach is to utilize a ski boot with an adjustable sole that can pivot along a longitudinal axis as depicted in U.S. Pat. No. 5,615,901.

Each of the above listed approaches suffer from a number of disadvantages:

(a) While the classic method of using wedge-shaped shims or "cants" can be effective for altering a skier's cant angle, it requires a time intensive process of custom mounting or remounting the binding on each pair of the customer's skis. In most cases, a technician must first cut and drill the appropriate cant shim material to match the shape and screw hole pattern of the particular binding being used. Next, the technician must carefully choose longer length screws to install the binding with the cants to meet International Standard ISO 8364 for screw depth and binding retention forces. If the screws chosen are a little too long, an expensive ski can easily be ruined. If screws are too short, the binding can pull out leading to potential skier injury. Because screw head shapes are often specific to particular binding brands and models, screws must be stocked in a multitude of styles and various lengths.

(b) The above procedure also creates a specific left and right ski due to the angular orientation of the cant shims installed. This prevents a skier from reversing his left and right skis out on the hill which is desirable as edges become dull or damaged, especially for performance minded skiers like instructors, patrollers and racers.

(c) There is also a growing retail trend towards selling more integrated ski-binding systems. On many of these systems, the binding is not attached to the ski with screws, but by various other means such as sliding the binding onto rails or tracks integrated into the ski construction. In these cases, the classic method of installing cant shims is not possible.

(d) An ever increasing number of skiers want to rent skis versus own, or at least "demo" various models before they buy. Due to the time requirement and cost of installing cant shims, canted rentals are simply not practical. Yet proper canting can make the difference between a great skiing experience and never wanting to ski again.

(e) Due to the above problems and limitations on installing cant shims, a small percentage of ski shops and skiers prefer to permanently grind or plane the bottom toe and heel sole portions of the boot. This method is known as "sole planing". Unfortunately, sole planing is often an imprecise operation that requires the use of dangerous machinery by ski shop employees. Because its irreversible, a slight mistake can ruin an expensive pair of boots. It also requires that the boot toe and heel sole portions be built back up to meet International Standard ISO 5355 for boot sole thickness and shape dimensions.

(f) The use of interchangeable canted soles, as described in U.S. Pat. Nos. 4,078,322 and 4,945,659, requires that a special boot be purchased and that the ski shop stock an assortment of canted soles only useful for the particular boot that supports the feature. Due to the cost of producing interchangeable canted soles, they have only been available in gross cant angle increments of I degree or greater. Only a limited number of boot models on the market accept this feature.

(g) The production and use of the ski boot design in U.S. Pat. No. 5,615,901 with a pivoting adjustable sole has not proven to be practical because of mechanical problems of implementation and the added weight and cost to produce the boot. This patented product is no longer on the market.

OBJECTS AND ADVANTAGES

Accordingly, a need exists for a simple canting solution to overcome all of the problems of the prior art above. Several objects and advantages of the present invention are:

(a) to provide an apparatus and method for canting a skier that is fast and efficient, that doesn't require the custom mounting or remounting of each pair of skis by a skilled or highly trained technician, or have the potential for damaging the ski, or cause the binding to pull out which could lead to potential injury, nor the need to stock a multitude of screw styles in various lengths to meet International ISO Standards;

(b) to provide an apparatus and method for canting a skier that allows the left and right skis and any canting to be reversed or changed out on the hill as desired;

(c) to provide an apparatus and method for canting a skier on integrated ski-binding systems;

(d) to provide an apparatus and method for canting a skier on rental or "demo" skis, both quickly and cost effectively, to enhance the skier's experience and increase the desire to continue in the sport;

(e) to provide an apparatus and method for canting a skier that is accurate and reversible, and that doesn't require dangerous grinding or planing of the bottom toe and heel sole portions of the boot, nor any building up of these sole portions to meet any International ISO Standards;

(f) to provide an apparatus and method for canting a skier that can be used with any boot and produced cost effectively in cant angle increments finer than 1 degree; and (g) to provide an apparatus and method for canting a skier that is practical, lightweight, inexpensive and widely available.

Still further objects and advantages are to provide an apparatus and method for canting a skier that only has to include a modification under the heel support portion of a boot or binding, that is designed to induce a prescribed cant angle prescribed for a particular skier, that can be designed compatible with the majority of bindings and skis on the market, and manufactured cost effectively out of well known materials, in various colors, and with visible labeling in a desired location to identify the cant angle. Still further objects and advantages will become apparent from a consideration of the ensuing description and drawings.

DETAILED DESCRIPTION OF THE INVENTION

Reference will now be made in detail to various embodiments of the invention. Examples of these embodiments are illustrated in the accompanying drawings. While the invention will be described in conjunction with these embodiments, it will be understood that it is not intended to limit the invention to any embodiment. On the contrary, it is intended to cover alternatives, modifications, and equivalents as may be included within the spirit and scope of the invention as defined by the appended claims. In the following description, numerous specific details are set forth in order to provide a thorough understanding of the various embodiments. However, the present invention may be practiced without some or all of these specific details. In other instances, well known process operations have not been described in detail in order to not unnecessarily obscure the present invention.

The inventor has discovered through analysis of current ski binding function, the biomechanics of skiing, and extensive experimental testing of hundreds of skiers, that a skier can be effectively canted by making modifications under only the heel support portion of a boot or binding. This has allowed the design of a novel system of canting that eliminates all of the problems listed above for actual and proposed canting systems. In the following, various embodiments of an apparatus and method for canting a skier are described that are extremely effective in altering the cant angle at which a boot supports a skier's foot and lower leg, relative to the longitudinal running surface or bottom plane of an attached ski. Optimizing the cant angle improves skeletal alignment and allows the skier to tilt or "edge" the ski with the least amount of muscular effort.

Figure 1A:
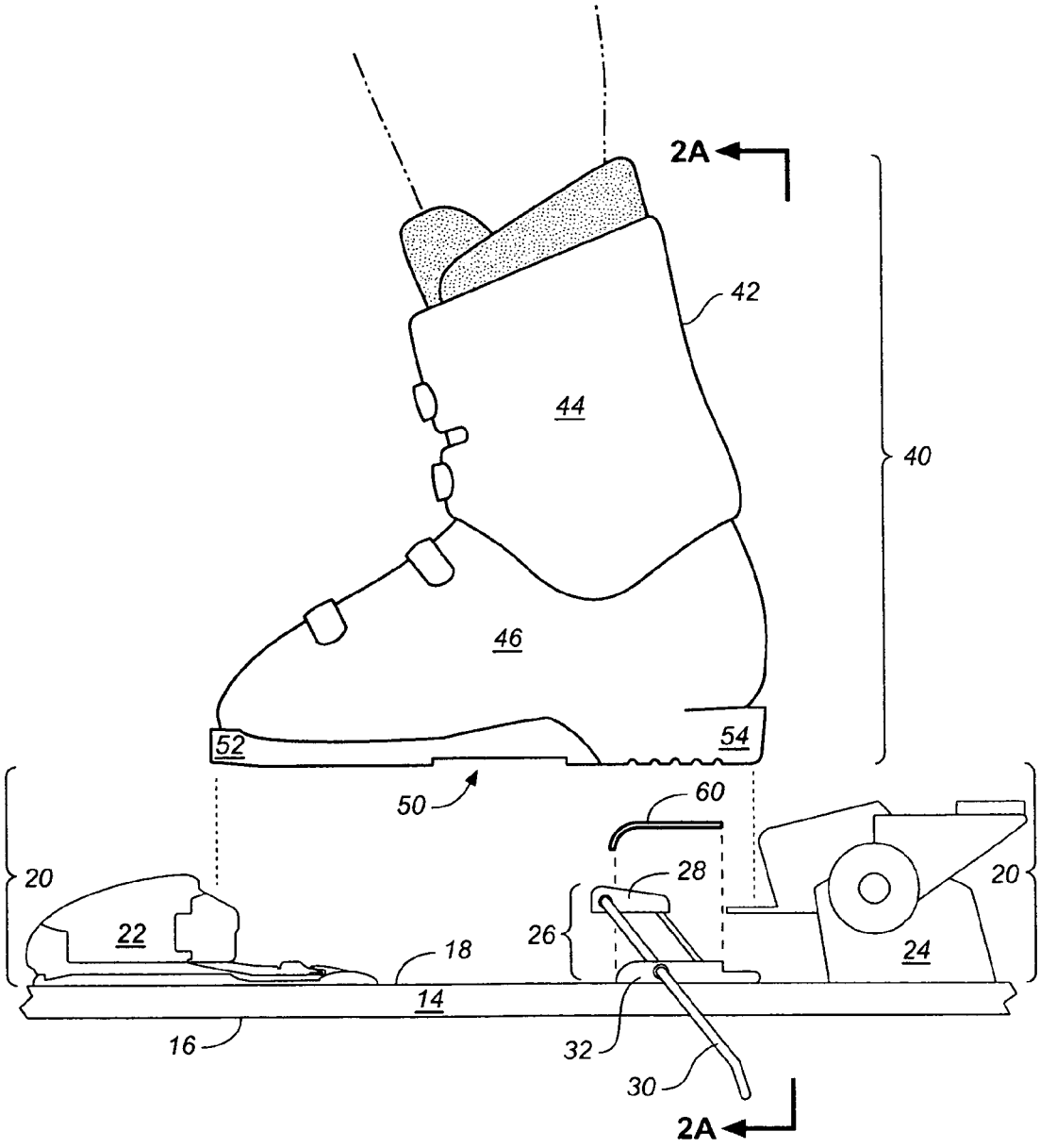
FIGS. 1A-B are side views of an embodiment of the invention integrated into a ski binding system.

Referring now to the drawings where like numerals are used throughout the several views to indicate like or corresponding parts, FIG. 1A is an exploded side view of a standard boot, binding and ski and an embodiment of the present invention where the boot is not retained by the binding. In FIG. 1A, a portion of a ski 14 is depicted having a running surface 16, which contacts the snow when skiing, and an upper surface 18 on which a binding 20 is mounted. Bindings come in many designs; however FIG. 1 depicts generic components which are included in most bindings. A detailed description of the function of the components will be provided below.

The binding 20 includes a toe unit 22, a heel unit 24, and an integrated brake system 26. All ski and binding systems are required by ski areas to include a leash or integrated brake system 26 which usually comprises a brake compressor plate 28, a brake arm 30 on either side of the ski, and a brake heel bearing surface 32.

FIG. 1A also depicts a generic ski boot 40 having an outer shell 42 including an upper cuff 44 for supporting the skier's lower leg and a lower shell 46 for supporting the skier's foot. The boot also includes a sole 50 having a boot toe portion 52 that is engaged by the toe unit 22 of the binding and a boot heel portion 54 that is engaged by the heel unit 24 of the binding.

Different embodiments of a cant angle plate (CAP) 60 are designed either to mate with a standard heel bearing surface 32, to replace a standard heel bearing surface 32, or to mate with a modified heel bearing surface 32, as described in detail later.

Figure 1B:
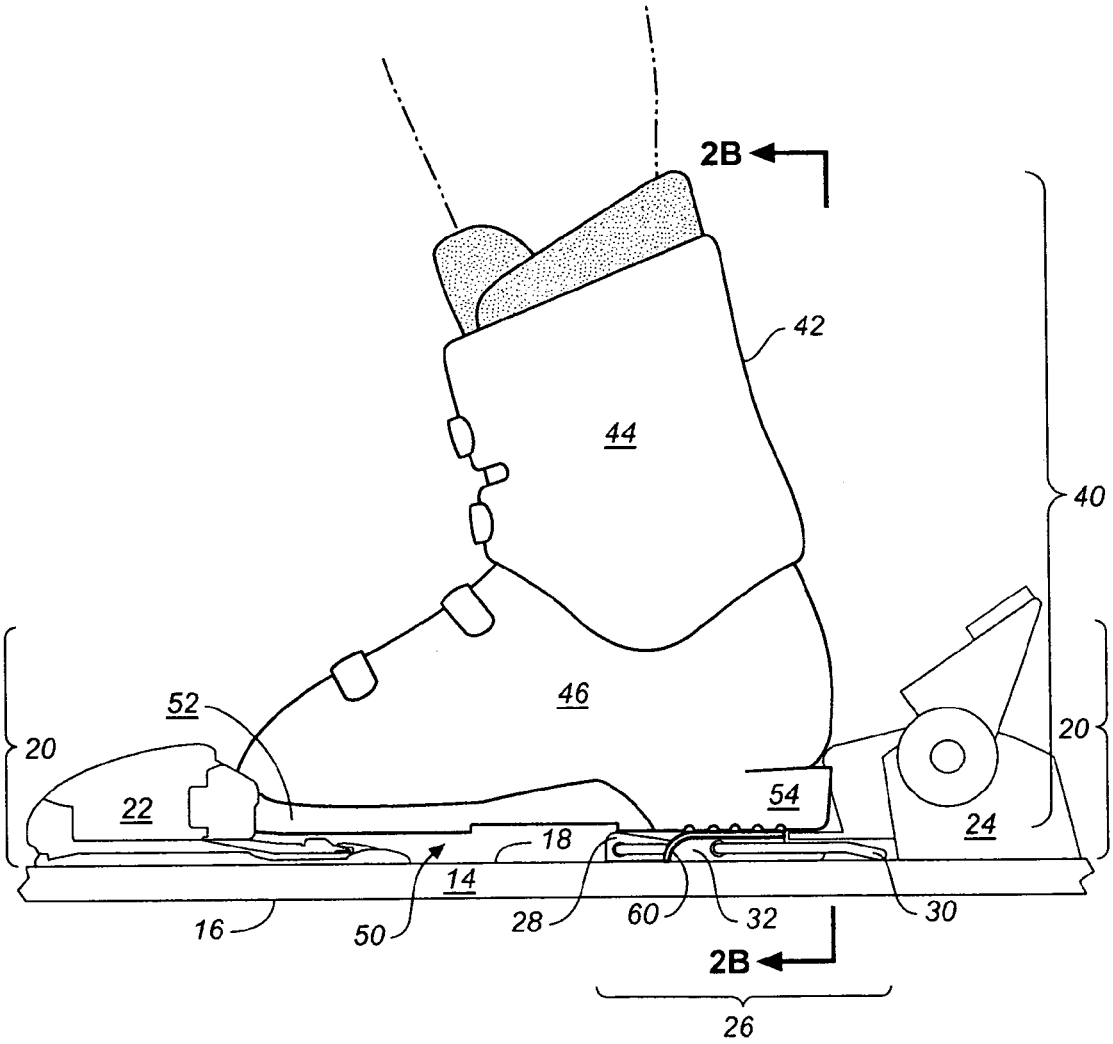

FIG. 1B includes the same components as FIG. 1A and depicts the ski boot 40 retained by the binding 20. The boot toe portion 52 of boot sole 50 is retained by the toe unit 22 of binding 20 and the boot heel portion 54 of boot sole 50 is retained by the heel unit 24 of binding 20. In this embodiment the lower surface of boot heel portion 54 of boot sole 50 does not directly contact the heel bearing surface 32 of integrated brake system 26, but instead rests on the upper surface of CAP 60.

Figure 2A:
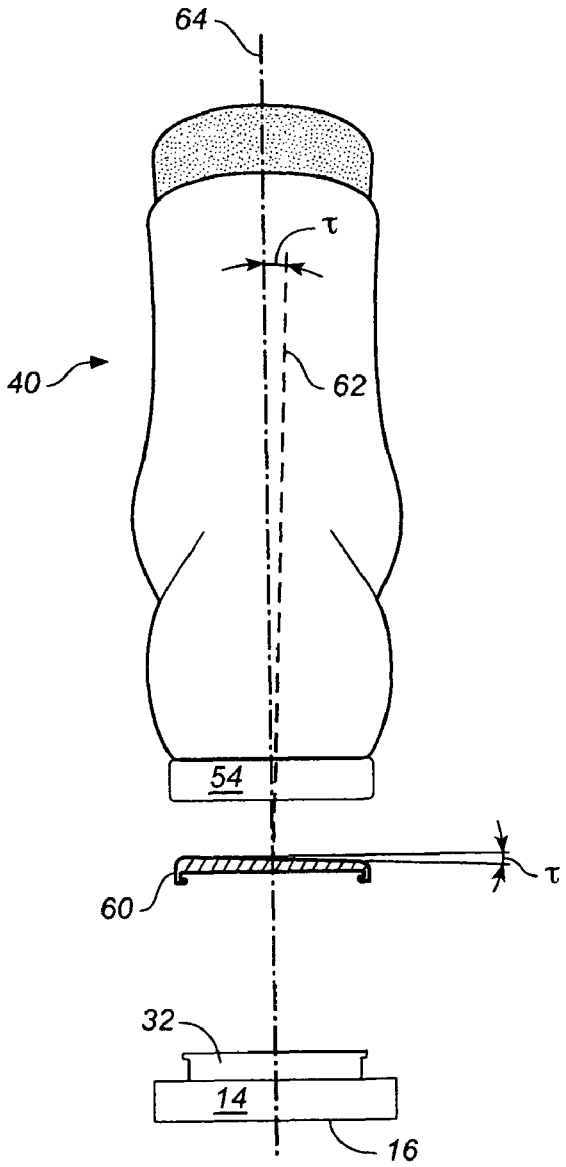
FIGS. 2A-B and 3A-B are simplified rear views showing a cutaway of the embodiment depicted in FIGS. 1A-B.
Figure 2B:
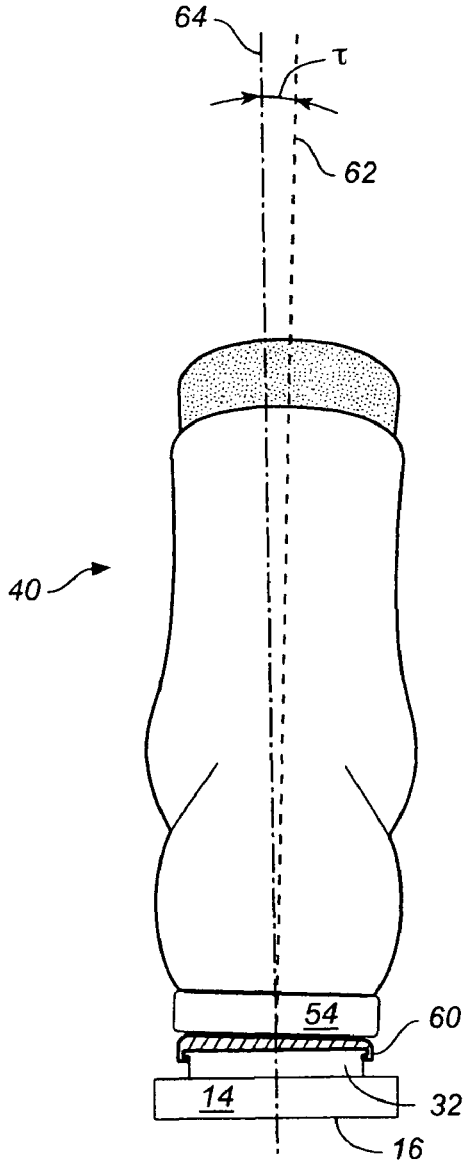

FIGS. 2A and 2B are simplified cut away rear views of ski boot 40, CAP 60, heel bearing surface 32 and ski 14 of FIGS. 1A and 1B respectively, taken along the view lines 2A-2A and 2B-2B. In FIGS. 2A-2B, the horizontal cross-sectional thickness of the exemplary CAP 60 decreases from left to right to form a planar upper surface having a normal CAP axis 62 tilted at a tilt angle ($\tau$) defined as the angle between a normal ski axis 64 perpendicular to the running surface 16 of the ski and the normal CAP axis 62 perpendicular to the planar upper surface of CAP 60. The upper surface of CAP 60 also is oriented at tilt angle τ from a horizontal line parallel to running surface 16 of the ski.

As depicted in FIG. 2B, because the lower surface of boot heel portion 54 rests directly on the upper surface of CAP 60 and is forced down on heel bearing surface 32 by the retention force of heel unit 24 (not shown), the entire boot 40 is forced to tilt from normal ski axis 64 by the angle τ.

Figure 3A:
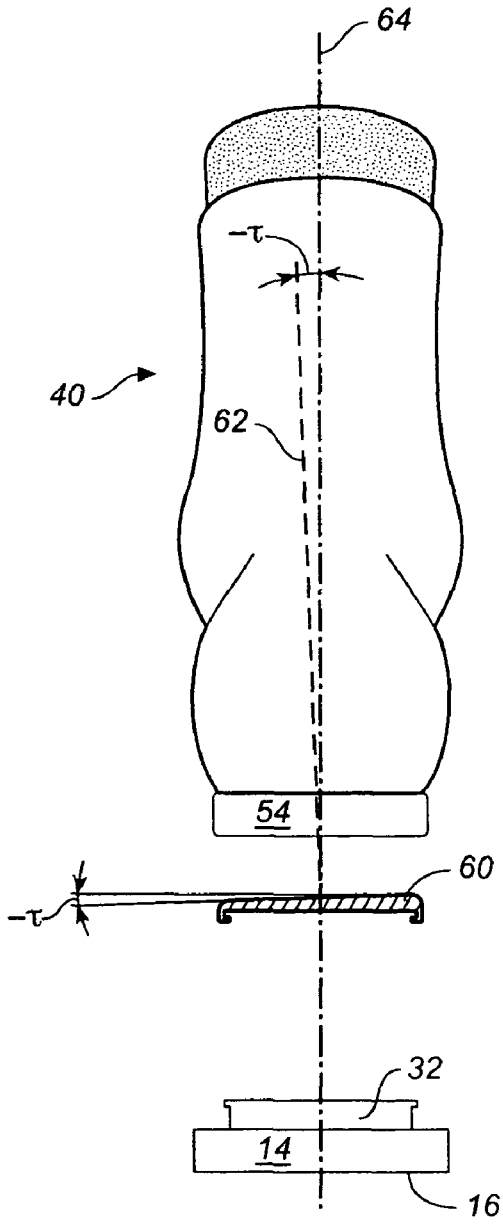
Figure 3B:
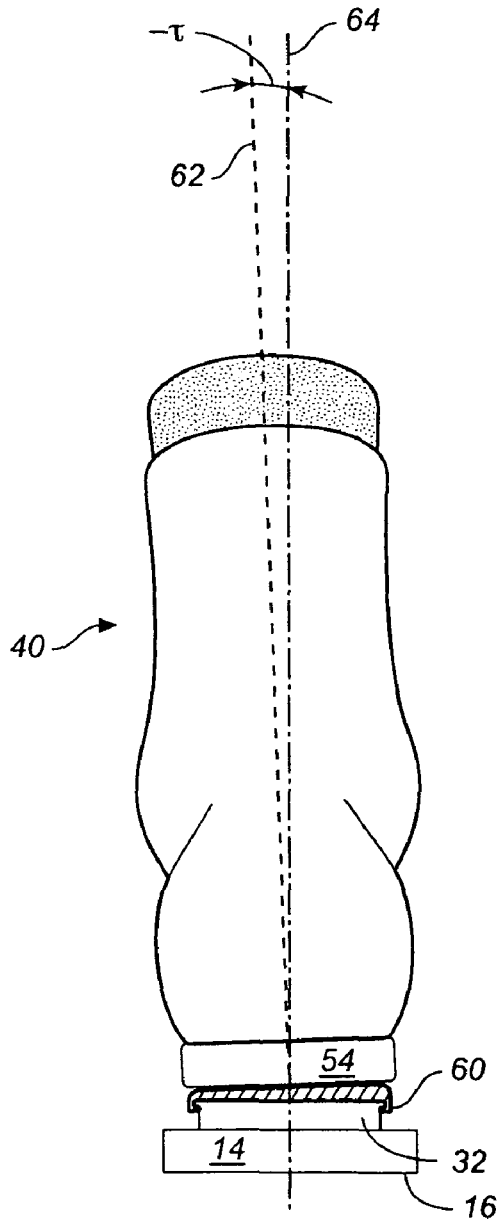

FIGS. 3A-B depict a CAP having a horizontal cross-sectional thickness that decreases from right to left to form a planar upper surface having a normal CAP axis 62 tilted relative to the normal ski axis 64 at an angle of −τ.

FIGS. 4-8 illustrate various embodiments of CAP 60 designed to solve problems posed by different industrial designs of the heel bearing surface included in different brands of bindings. Each view is the same as the view of FIGS. 2A-B but only the heel bearing surface 32 and CAP 60 are depicted.

Figure 4A:
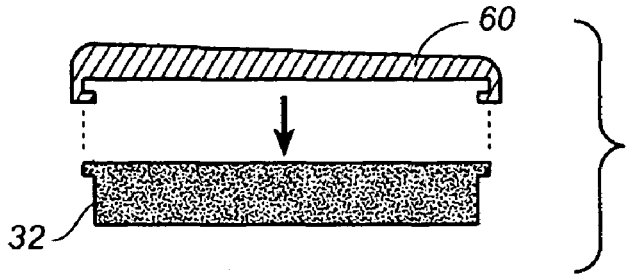
FIGS. 4A-B are cross-sectional views depicting a lock on embodiment of a CAP (Cant Angle Plate)
Figure 4B:
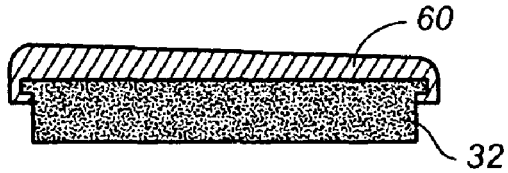

FIGS. 4-6 illustrate "retrofit" techniques that allow the heel bearing surface 32 of an existing commercially available binding to accept a CAP 60. Three different embodiments are depicted.

In FIGS. 4A and B the industrial design of the heel bearing surface 32 is such that its shape allows a lock on CAP 60 to be designed that will lock onto existing features of heel bearing surface 32. By way of illustration, heel bearing surface 32 depicted in FIG. 4A has protrusions which allow CAP 60 to be designed as a female part that will lock onto these protrusions. It is also necessary that the industrial design of the brake or heel unit allows CAP 60 to be locked onto heel bearing surface 32 without interference from other parts of the binding.

A detailed description of a preferred lock on embodiment of a CAP, designed for a particular commercial binding, will be described in detail below with reference to FIGS. 9A-H.

Figure 5A:
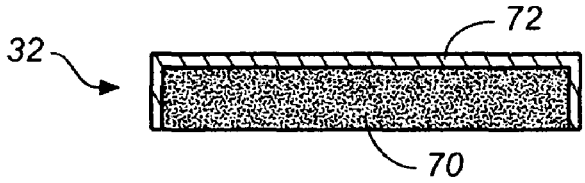
FIGS. 5A-D are cross-sectional views depicting a replacement embodiment of a CAP.
Figure 5B:
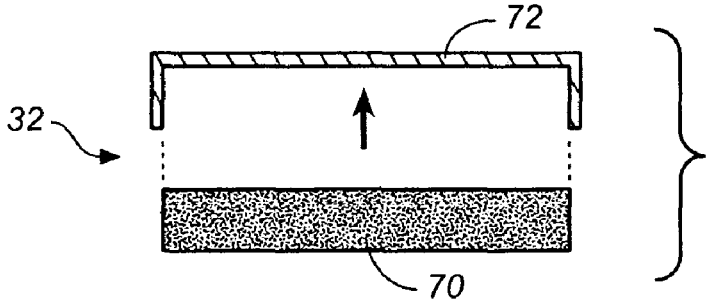

In FIGS. 5A-D the industrial design of the binding does not facilitate the use of the lock on CAP of FIG. 4 because other parts interfere; there is no structure to facilitate locking on, or for other reasons. FIG. 5A depicts a heel bearing surface 32 having an interior structure 70 including metal parts, for example, and a removable outer structure 72, which is usually plastic, that has an upper surface on which the heel portion of the ski boot sole rests and which can be easily removed as depicted in FIG. 5B.

Figure 5C:
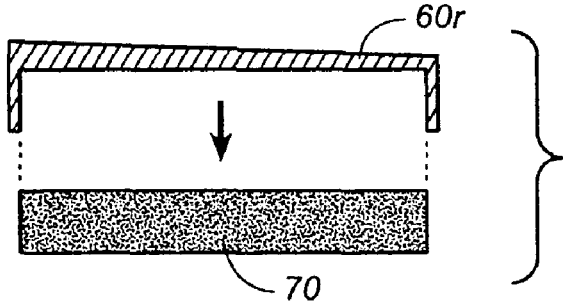
Figure 5D:
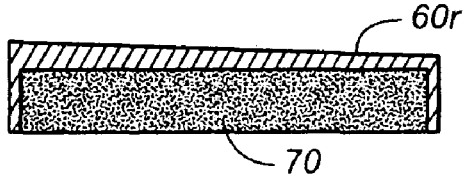

FIGS. 5C-D depict an embodiment of the invention in the form of a replacement CAP 60*r* having an interior portion the same as the removable outer structure 72 so that it may be connected to the interior structure 70. However, the cross sectional thickness of the upper part of replacement CAP 60*r* varies so that the upper planar surface of replacement CAP 60*r* forms an angle of τ relative to the running surface 16 of the ski (not pictured).

In practice, the removal of the standard outer structure 72 and installation of replacement CAP 60*r* is a simple operation that can be performed quickly by ski shop personnel.

FIGS. 6A-D depict a variation of the embodiment of FIG. 5D that provides an adaptor part 74 to allow the use of interchangeable lock on CAP 60. The adaptor part 74 has an interior portion identical to the removable outer structure 72 (FIG. 5A-B) so that it can be connected to the interior structure 70 of the heel bearing surface 32. The outer part of adaptor part 74 includes structure that provides protrusions for a lock on CAP 60 to lock onto. This embodiment also requires that the industrial design of the brake or heel unit does not interfere with the locking-on of lock on CAP 60.

Figure 7A:
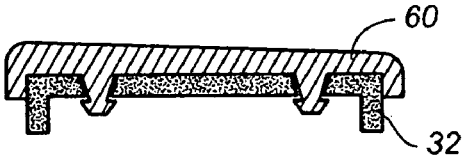
FIGS. 7A-B are cross-sectional views depicting a heel bearing surface having mounting structures that allow connecting an embodiment of a CAP to the heel bearing surface.
Figure 7B:
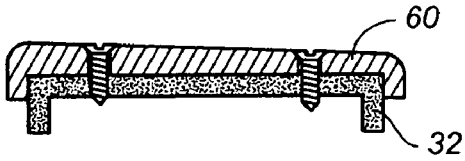

FIGS. 7A-B depict an embodiment for use with a commercially available integrated ski brake or heel unit having a heel bearing surface that does not have a shape that permits locking-on and is not easily removable. In this embodiment, the heel bearing surface 32 has been modified by the manufacturer or ski shop personnel to include one or more holes or other mounting structures to facilitate mounting a CAP 60. By way of example, in FIG. 7A the heel bearing surface 32 has holes positioned to receive pins protruding from the lower surface of CAP 60 with each pin having a wider tip which locks into a respective hole. FIG. 7B depicts a heel bearing surface 32 having holes to accept screws or other means for fastening CAP 60 to heel bearing surface 32.

Figure 8:
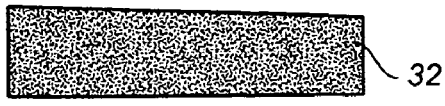
FIG. 8 is a cross-sectional view depicting a replacement brake embodiment of the invention.

FIG. 8 depicts a solution useful where a brake heel bearing surface 32 is not removable, for example where it is molded around the brake arms and the industrial design is such that interference prevents the use of a lock on CAP. In this example the manufacturer assembles a brake with a heel bearing surface having an upper surface for providing a tilt of a selected angle τ. The brake can be labeled or packaged with an indication of the tilt angle so the skier may select a brake with a desired tilt angle that can be mounted on the binding.

Figure 6A:
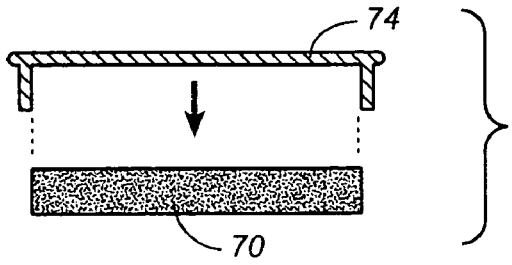
FIGS. 6A-D are cross-sectional views depicting an adaptor piece for receiving a lock on embodiment of a CAP.
Figure 6B:
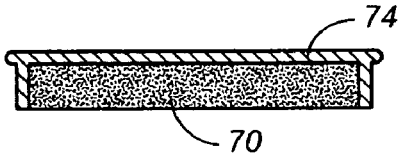
Figure 6C:
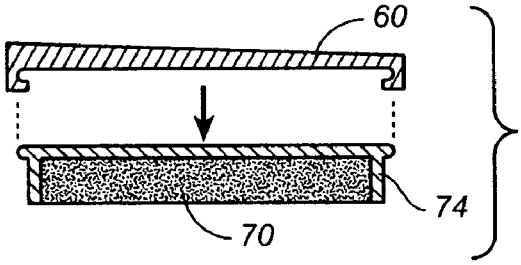
Figure 6D:
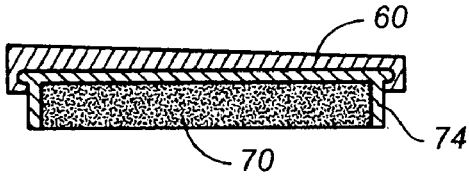

In each embodiment that includes a CAP, a CAP having a τ of 0° can be utilized initially or in the case where the skier does not require any tilt to be properly canted. For example, manufacturers could ship bindings with a 0° CAP 60 attached to an adaptor part 74 (FIG. 6C). Furthermore, for all embodiments the thickness of the various parts are designed so that any added step height is within the functional retention range tolerances of the heel unit of the binding. A preferred thickness can also be provided at any lateral point, for example in the center of each CAP, to create a common point of thickness on various angled CAPS.

FIGS. 9A-9H depict a preferred lock on embodiment of CAP 60 designed to lock onto structural features that are part of the industrial design of a common ski brake heel bearing surface 32, manufactured by Marker®.

Figure 9A:
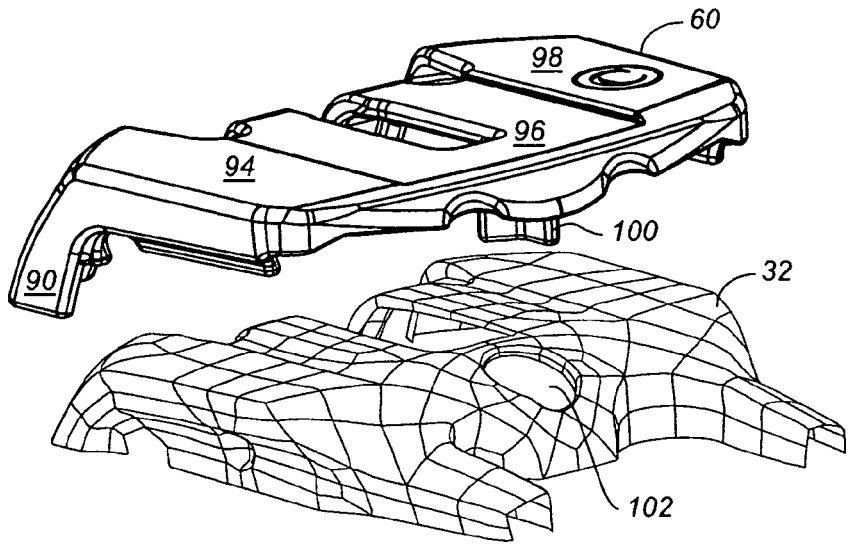
FIGS. 9A-H are detailed views of a preferred lock on embodiment of the invention.
Figure 9B:
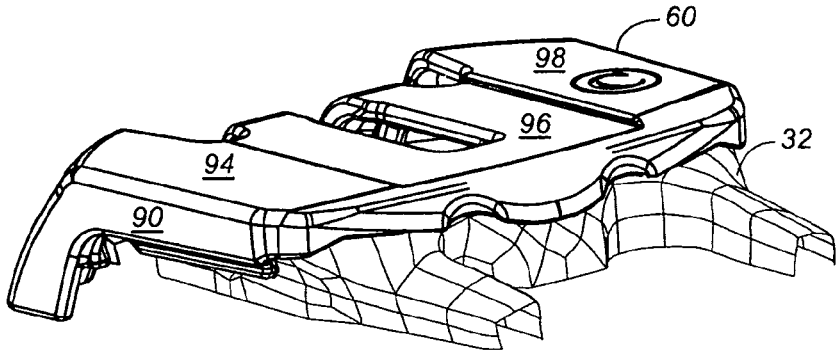
Figure 9C:
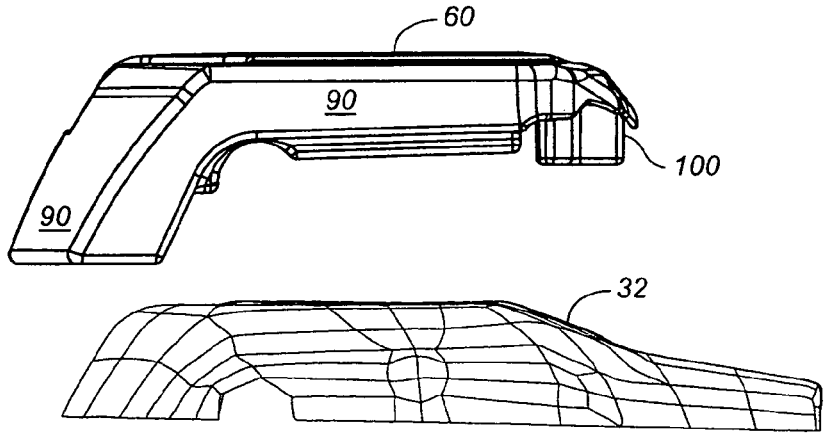
Figure 9D:
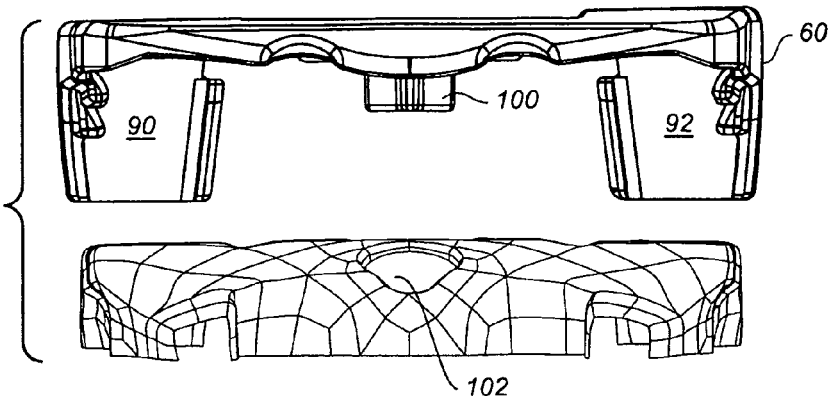

FIGS. 9A and 9B are left rear perspective views of the lock on CAP 60 exploded above and then locked on the Marker® heel bearing surface 32. FIG. 9C is an exploded left side profile view. FIG. 9D is an exploded rear end view. In FIGS. 9A-9D, the Marker® heel bearing surface 32 is depicted with contour lines indicating the shape of the surface. Furthermore, lock on CAP 60 includes left and right shrouding parts 90 and 92, left, center and right sections 94, 96, and 98, and an insertion member 100 (depicted in greater detail in FIGS. 9G-9H). The sides of the shrouds 90 and 92 are shaped to fit over complementary shaped sections of the heel bearing surface 32 to affect a secure mechanical lock. The lock is further stabilized by the mating of the insertion piece 100 with an upper opening 102 (seen in FIGS. 9A and 9D) of the Marker® heel bearing surface 32.

Figure 9E:
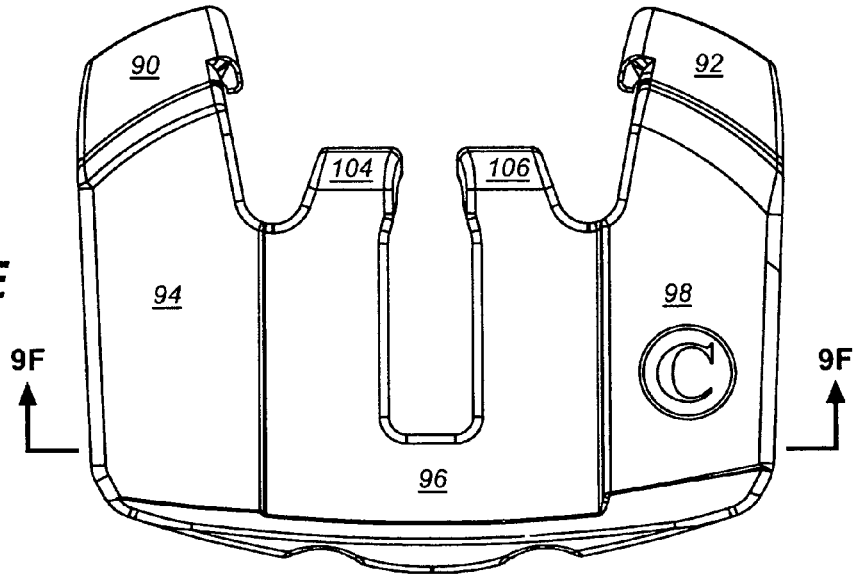
Figure 9F:
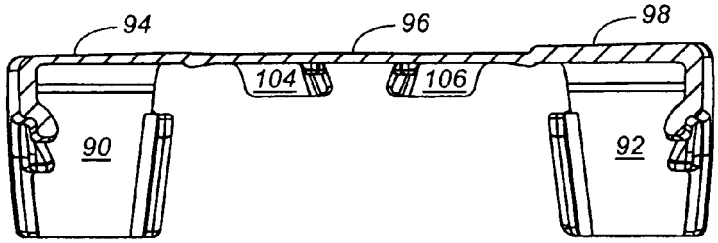
Figure 9G:
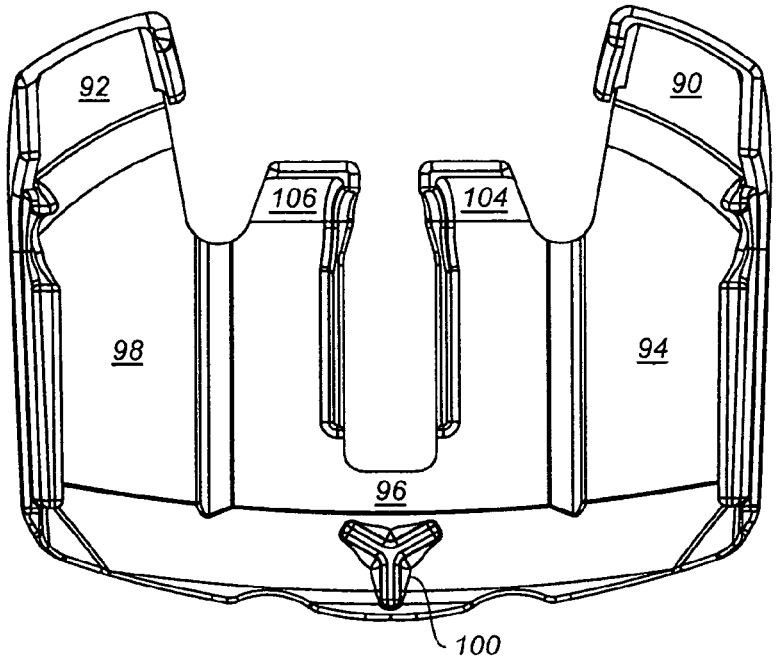
Figure 9H:
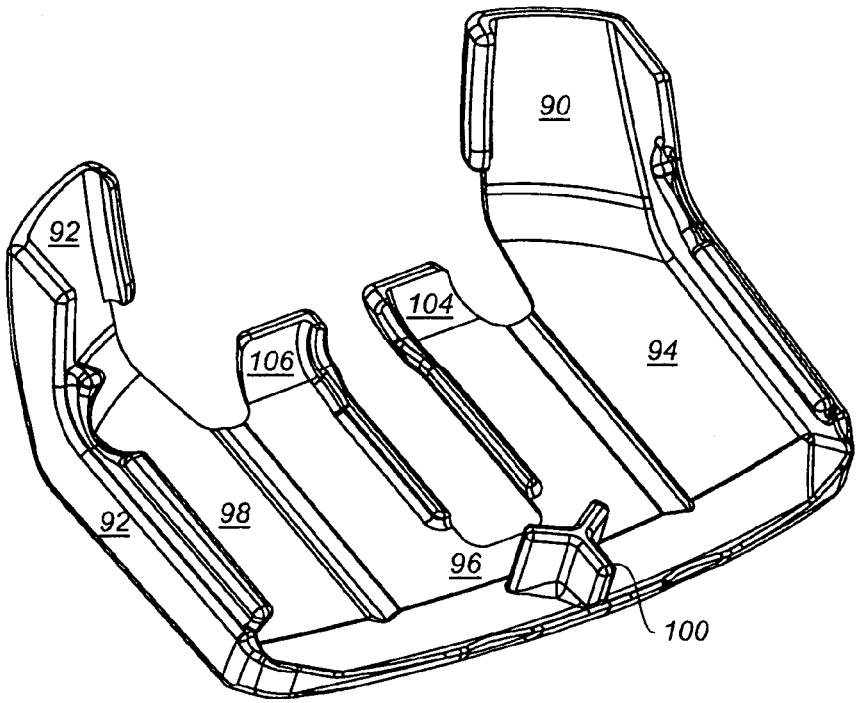

FIG. 9F depicts a cross-section rear end view of FIG. 9E along view line 9F of the upper surface of lock on CAP 60 that induces a tilt of 1° to the left. Note that the upper surface of the center section 96 is lower than the upper tilted surfaces of the right and left sections 94 and 98 so that the boot (not shown) is substantially supported by the upper tilted surfaces of the right and left sections 94 and 98. To create a tilt of 1°, the far right thickness of section 98 is approximately 40/1000 (0.040) of an inch thicker than the far left thickness of section 94. Also, by supporting the boot substantially on these right and left sections, a wobble caused by a slightly higher center section of the common Marker® heel bearing surface 32 is reduced or eliminated. In this case a 0° CAP 60 would be useful to stabilize the skier even if no cant angle alteration were required.

Additionally, the left and right shrouds 90 and 92 and additional center shrouds 104 and 106 (seen in FIGS. 9E-9H) prevent snow and debris from building up between the lower surface of the lock on CAP 60 and the Marker® heel bearing surface 32. This is beneficial because debris or snow buildup with a thickness of even 10/1000 (0.010) of an inch lodged between the heel bearing surface and lower surface of the lock on CAP 60, for example, could induce an undesirable cant angle change of approximately ¼° or possibly damage the lock on CAP 60 or induce wobble.

To better understand the operation and effectiveness of the invention, it is helpful to understand at least basic binding function. Most modern bindings include a toe unit and a heel unit that attach the boot to the ski in two separate places, and that function in different ways to provide effective retention of the boot to the ski for control, and effective release of the boot from the ski in various directions for safety, as in the case of a fall.

The toe unit captures or retains the toe portion of the boot sole for control, and provides primarily lateral release in twisting falls and sometimes vertical release in backward falls. Since twisting falls and backward falls can be quite dangerous, a lower retention force is provided in the toe unit to allow these directions of release. Furthermore, mechanical play or elasticity is purposefully designed into the toe unit. The first reason is to accommodate for allowable boot sole shape tolerances and expected wear. Another reason is to enhance release when needed by minimizing or reducing friction between the boot sole and toe unit. Due to the combined affect of the lower retention force and mechanical play or elasticity, the toe unit does not capture or hold the boot down against the ski, relative to the longitudinal running surface, as aggressively as the heel unit.

The heel unit captures or retains the heel portion of the boot sole for control, and provides primarily vertical release in forward falls. Due to a skier's forward momentum and the desire to prevent a premature vertical release while skiing, a much higher retention force is designed into the heel unit. Therefore, it is the heel unit of the binding that most securely holds the boot down against the ski, relative to the longitudinal running surface, with the highest degree of retention force. Thus, the strong downward retention force of the heel unit combined with the mechanical play or elasticity of the toe unit, provide that a cant angle change at only the heel bearing surface of the binding, with no similar cant angle change at the toe bearing surface, is sufficient to alter the cant angle at which a boot supports a skier's foot and lower leg, relative to the longitudinal running surface or bottom plane of an attached ski.

CONCLUSION, RAMIFICATIONS, And SCOPE

Accordingly, various embodiments of an apparatus and method for canting a skier have now been described which are compatible with existing binding systems, that can be used to modify existing binding systems, or can be manufactured into existing binding systems by binding manufacturers. All of these embodiments provide a fast, accurate, reversible, safe and inexpensive means to alter a skier's cant angle, and can be easily applied by any ski shop personnel or by the skier himself.

While the above description contains much specificity, this should not be construed as limitations on the scope of the invention but as merely providing illustrations of some of the presently preferred embodiments of the invention. Many alternatives and substitutions will now be apparent to persons of skill in the art.

Thus the scope of the invention should be determined by the following their legal equivalents, not by the examples given.

What is claimed is:

1. A cant angle plate configured to rest on and mate with a heel bearing surface of a ski binding having a heel portion and a toe portion, where a heel portion of a boot attached to the ski binding rests on the heel bearing surface of the ski binding, and with the heel bearing surface of the ski binding having features or structure as part of its design, the cant angle plate comprising:

an upper surface having one or more sections of variable thickness configured to form a selected cant angle or tilt angle;

one or more mating surfaces configured to rest on the heel bearing surface of the ski binding; and one or more complementary mating elements configured to mate with the features or structure of the heel bearing surface of the ski binding, with the mating surface, upper surface and one or more complementary mating elements configured so that the cant angle plate rests on and mates with the heel bearing surface of the ski binding and does not mate with the toe portion of the ski binding.

2. The cant angle plate of claim 1 where one or more shrouding parts form one or more shrouds for preventing snow or debris from building up or lodging between the heel bearing surface of the ski binding and the one or more mating surfaces or one or more mating elements of the cant angle plate.

3. The cant angle plate of claim 1 where the heel bearing surface of the ski binding includes one or more openings, the cant angle plate further comprising:

one or more insertion members or pieces, disposed on the cant angle plate, that mate with the one or more openings of the heel bearing surface of the ski binding when the cant angle plate rests on the heel bearing surface of the ski binding.

4. The cant angle plate of claim 1 where the one or more sections of variable thickness of the upper surface are formed and disposed to reduce or eliminate wobble caused by the design or shape of the heel bearing surface of the ski binding.

5. The cant angle plate of claim 1 further comprising:

one or more visible markings that describe the cant angle plate such as left or right, cant angle induced, or thick or thin sections.

6. The cant angle plate of claim 1 with a selected cant angle or tilt angle substantially of about zero degrees to be used initially or in the case where the skier does not require any cant angle or tilt angle correction to be properly canted.

7. The cant angle plate of claim 1 where the heel bearing surface of the ski binding includes one or more holes to accept screws and with the cant angle plate further comprising:

one or more holes to accept screws to pass through the cant angle plate to fasten the cant angle plate to the heel bearing surface of the ski binding.

8. The cant angle plate of claim 1 where the heel bearing surface of the ski binding includes one or more holes to accept pins and with the cant angle plate further comprising:

one or more pins protruding from the one or more mating surfaces of the cant angle plate and positioned to pass through the holes in the heel bearing surface of the ski binding and with the pins having wider tips to mount or fasten the cant angle plate to the heel bearing surface of the ski binding.

9. The cant angle plate of claim 1 where the heel bearing surface of the ski binding includes one or more mounting structures to accept fastening structures and with the cant angle plate further comprising:

one or more fastening structures adapted to fasten the cant angle plate to the heel bearing surface of the ski binding.

* * * * *